United States Patent [19]

Gattu et al.

[11] 4,217,987

[45] Aug. 19, 1980

[54] ACTUATOR FOR TELESCOPIC BOOM

[75] Inventors: Narahari Gattu; Paul E. Johnson, both of Cedar Rapids, Iowa

[73] Assignee: Harnischfeger Corporation, W. Milwaukee, Wis.

[21] Appl. No.: 965,561

[22] Filed: Dec. 1, 1978

[51] Int. Cl.[3] ..... B66C 23/04

[52] U.S. Cl. ..... 212/144; 52/118

[58] Field of Search ..... 212/55, 144; 52/115, 52/118

[56] References Cited

U.S. PATENT DOCUMENTS

| | | | |
|---|---|---|---|
| 2,684,159 | 7/1954 | Oldenkamp | 212/55 |
| 3,112,035 | 11/1963 | Knight | 212/55 |
| 3,307,713 | 3/1967 | Bopp | 212/55 |

*Primary Examiner*—Robert G. Sheridan

*Attorney, Agent, or Firm*—James E. Nilles

[57] ABSTRACT

A telescopic boom comprises a base section, an inner section telescopable within the base section, an outer section telescopable within the inner section, and an actuator mechanism located within the outer section and operable to telescopically move the inner and outer sections relative to each other and to the base section. The actuator mechanism comprises an extendable and retractable elongated hydraulic cylinder or ram in the boom and comprising two relatively movable ram components, such as a cylinder housing and piston rod. One of the ram components (the piston rod) is connected to the base section and the other of the ram components (the cylinder housing) is connected to the inner section. An elongated cable support member is rigidly connected to the base section and extends into the boom. Means are provided to slideably support the first end of the hydraulic ram on the outer section and to slideably support the first end of the cable support member on the ram. First and second pulleys are mounted on the cylinder housing near opposite ends thereof, and first and second cables are reeved around the first and second pulleys, respectively. Each cable has one end anchored to the cable support member and the other end anchored to the outer section. The aforesaid other end of each cable is anchored to the outer boom section by an adjustable cable anchor assembly which is accessible from the exterior of the boom. Means are provided for extending and retracting the hydraulic ram to thereby cause the ram to telescopically move the inner section relative to said base section and to cause the pulley/cable system to telescopically move the outer section relative to the inner section.

18 Claims, 11 Drawing Figures

ACTUATOR FOR TELESCOPIC BOOM

TECHNICAL FIELD

This invention relates generally to multisection telescopic crane booms and, in particular, to actuator mechanisms for extending and retracting the boom sections.

BACKGROUND OF PRIOR ART

The prior art discloses many types of multisection telescopic crane booms and actuator mechanisms for extending and retracting the boom sections. In some prior art arrangements, each boom section is telescopically movable relative to another by means of its own individual hydraulic ram. In other prior art arrangements several boom sections are telescopically movable by one hydraulic ram. In the latter arrangements, for example, either releasable pin means are used to temporarily secure one boom section to another so that one ram can move both, or cable and pulley arrangements are used so that movement of one section by a ram effects movement of other sections. U.S. Pat. Nos. 3,396,601 and 3,605,358 disclose arrangements of the latter type wherein numerous pulleys and complex cable systems are required and wherein substantial portions of the cable-pulley systems are located on the exterior of the telescopic crane boom.

BRIEF SUMMARY OF THE INVENTION

In accordance with the present invention there is provided a multisection telescopic crane boom having an improved actuator mechanism of the cable-pulley type for extending and retracting the boom sections. The telescopic boom comprises a base (first) section, an inner (second) section telescopable within the base (first) section, an outer (third) section telescopable within the inner (second) section, and an actuator mechanism operable to telescopically move the inner (second) and outer (third) sections relative to each other and to the base (first) section. The actuator mechanism comprises an extendable and retractable elongated hydraulic cylinder or ram extending within the outer (third) section and comprising two (first and second) relatively movable ram components, such as a cylinder housing and a piston rod. The rear end of one ram component is connected to the rear end of the base (first) section, and the rear end of the other ram component is connected to the rear end of the inner (second) section. First (extend) and second (retract) pulleys are mounted on the said other ram component near opposite ends thereof. First and second cables are reeved around the first and second pulleys, respectively, with each cable having one end anchored to a cable support means and the other cable end anchored to the outer (third) section. The cable support means includes an elongated cable support member rigidly connected at one end to the base (first) section and extending into the outer (third) section. More specifically, the said other end of the first cable is anchored near the forward end of the outer (third) section and the said other end of the second cable is anchored near the rear end of the outer (third) section. The aforesaid other end of each cable is anchored near the ends of the outer (third) boom section by means, such as adjustable cable anchor assemblies, which are accessible for cable adjustment purposes from the exterior of the boom. Means are provided to slideably support the front end of the other ram component on the outer (third) boom section. Means are also provided to slideably support the front end of the cable support member on the ram. Means are provided for extending and retracting the ram to thereby cause the ram to telescopically move the inner (second) section relative to said base (first) section and to cause the pulley/cable system to telescopically move the outer (third) section relative to the inner (second) section.

A telescopic crane boom having an actuator mechanism in accordance with the present invention offers many advantages over the prior art. For example, only one ram, two pulleys, and two cables are required in a boom comprising three relatively movable sections, although redundancy of the pulleys and cables is desirable. The ram, pulleys, cables, and cable support, which form a unified assembly, are all located substantially within the outer (third) boom section when the boom is telescoped, and are not located in the clearance spaces between adjacent boom sections or on the exterior of the boom. Furthermore, the arrangement results in all loads being transmitted to the strong rear end of the base section. The advantages of not locating components within the aforesaid clearance spaces are that smaller clearance spaces can be employed thereby resulting in a more compact boom; that complex arrangements of complex inaccessible components are avoided thereby simplifying manufacture, assembly, and servicing; and that the components are located within the largest and roomiest enclosed space within the boom thereby facilitating manufacture and final assembly of the boom and design of the components. The use of exteriorly accessible adjustable anchor bolt assemblies to anchor the aforesaid other ends of the cables at opposite ends of the outer (third) section enables cable adjustments to be readily made as needed when the boom is retracted, without the necessity to disassemble the boom or attempt to work in awkward or confined quarters. A crane boom in accordance with the invention obtains maximum function and utility with a minimum number of simply arranged component parts, thereby reducing weight, risk of breakdown, and costs of manufacturing and servicing. Other objects and advantages of the invention will hereinafter appear.

DESCRIPTION OF A PREFERRED EMBODIMENT

Figure 1:
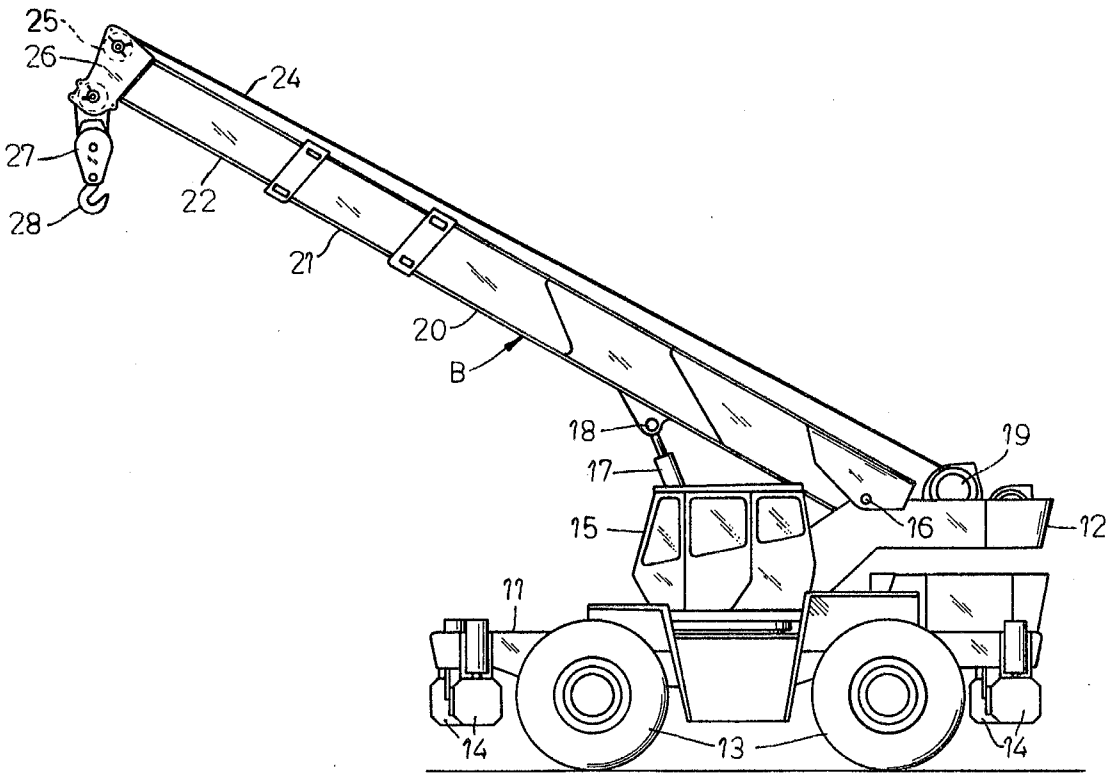
FIG. 1 is a side elevational view of a mobile crane having a multisection telescopic crane boom in which the invention is employed.

FIG. 1 shows a mobile crane 10 comprising a lower section 11 and a rotatable upper section 12 which supports a multisection telescopic boom B.

Lower section 11 includes ground engaging driven wheels 13 and extendable outriggers 14. Upper section 12 supports an operator's cab 15 and the multisection telescopic crane boom B, (shown partially extended in FIG. 1 and fully retracted in FIGS. 2 and 3). The rear end of boom B is pivotally connected by pin means 16 to crane upper section 12 to enable boom B to be pivotally movable in a vertical plane by means of an extendable and retractable hydraulic boom hoist cylinder 17 which is pivotally connected at one end to upper section 12 and pivotally connected at its other end to boom B by pin means 18. Crane upper section 12 also carries a winch 19 for a load line 24 which extends along boom B and is reeved about a load line pulley 25 on a boom point pulley support 26 at the point or forward end of outer section 22 of boom B. Load line 24 supports a block 27 having a hook 28 thereon.

As FIGS. 1–5 and 9 show, telescopic boom B comprises a base (first) section 20, an inner (second) section 21 telescopable within the base section 20, and an outer (third) section 22 telescopable within the inner section 21. An actuator mechanism 23 is located within boom B and is operable to telescopically move the inner and outer sections 21 and 22, respectively, simultaneously relative to each other and to the base section 20. The actuator mechanism comprises a cable support means 35 which is rigidly connected to the base section 20 and an extendable and retractable hydraulic cylinder or ram 30 comprising two relatively movable ram components 31 and 32, such as a hollow piston rod and a hollow cylinder, respectively. One of the ram components, such as piston rod 31, is connected at its rear end to the rear end of base (first) section 20. The other ram component, such as cylinder 32, is connected at its rear end to the rear end of inner boom section 21. Pairs of first and second rotatable pulleys 40 and 41, respectively, are mounted on the second ram components 32 near opposite ends thereof. Pairs of first and second cables 50 and 51, respectively, are reeved around the pairs of first and second pulleys 40 and 41, respectively, with each cable having one end anchored to the cable support means 35 and the other cable end anchored to the outer boom section 22 near an end thereof. The aforesaid other end of each cable 50, 51 is anchored to the outer boom section 22 by adjustable cable anchor assemblies 54, 55, hereinafter described, which are accessible from the exterior of the boom B. Means including slide pads 141 and 83 are provided to slideably support the forward end of hydraulic arm 30 on outer section 22 and to slideably support the forward end of cable support member 36 on ram 30, respectively. As FIG. 10 shows, control means 100 are provided for extending and retracting the ram 30 to thereby telescopically move the inner section 21 relative to the base section 20 and to telescopically move the outer section 22 relative to the inner section 21.

As FIGS. 2, 3, 4, and 9 show, each boom section 20, 21, 22 is fabricated of steel plate and is of hollow rectangular cross section. Furthermore, each section comprises a pair of spaced apart side walls or plates 62 which are edge-welded between a top wall or plate 60 and a bottom wall or plate 61. Slide pads such as 63 are provided at appropriate locations between adjacent relatively movable boom sections to reduce friction during telescopic movement.

Figure 2:
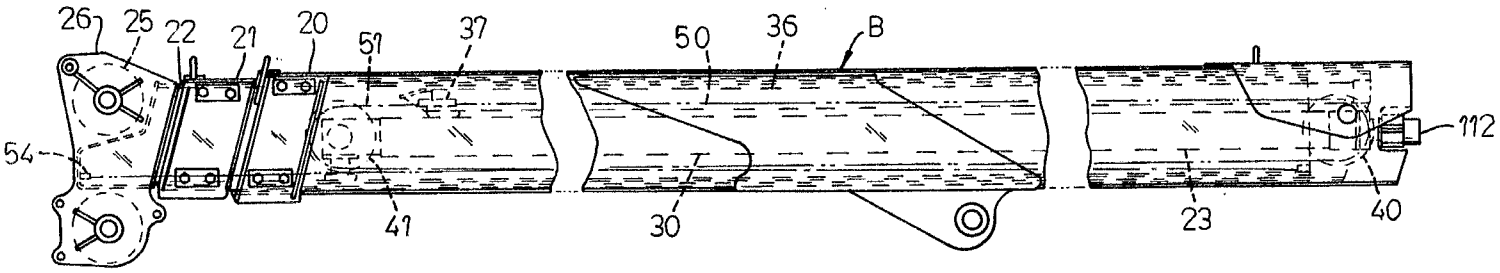
FIG. 2 is an enlarged side elevational view of the crane boom of FIG. 1 showing it fully telescoped.
Figure 3:
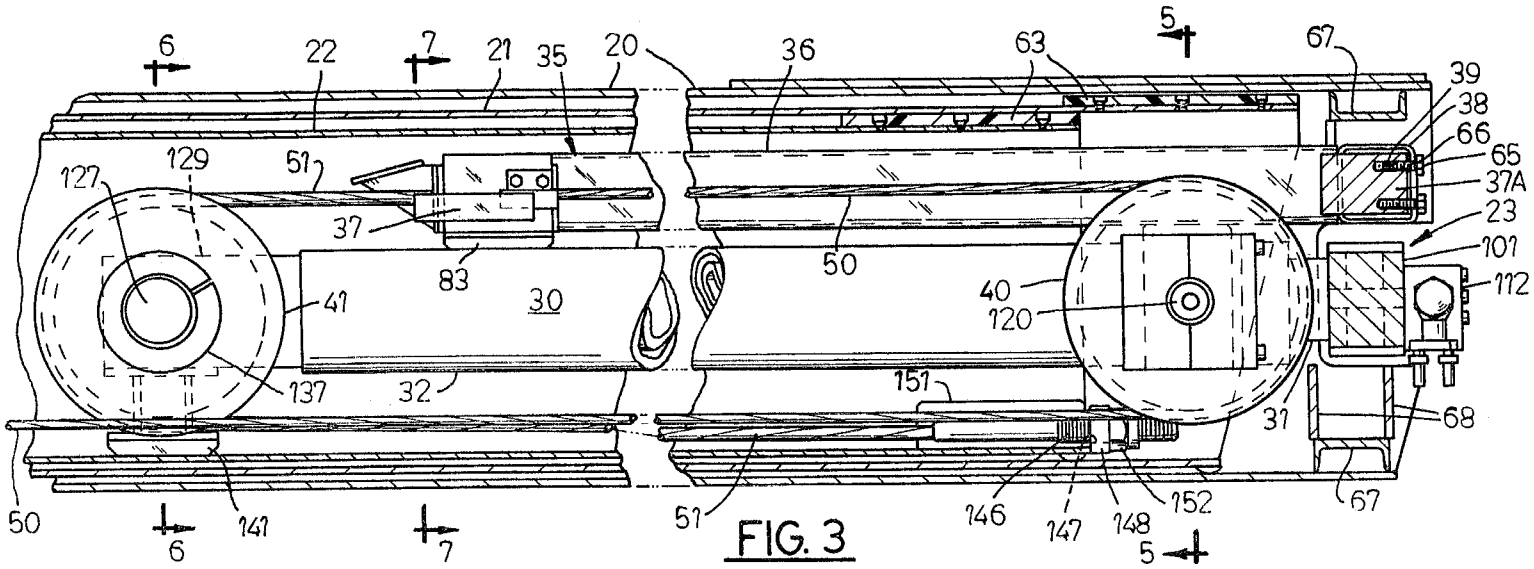
FIG. 3 is an enlarged cross-sectional view of the rear end portion of the crane boom of FIGS. 1 and 2.
Figure 9:
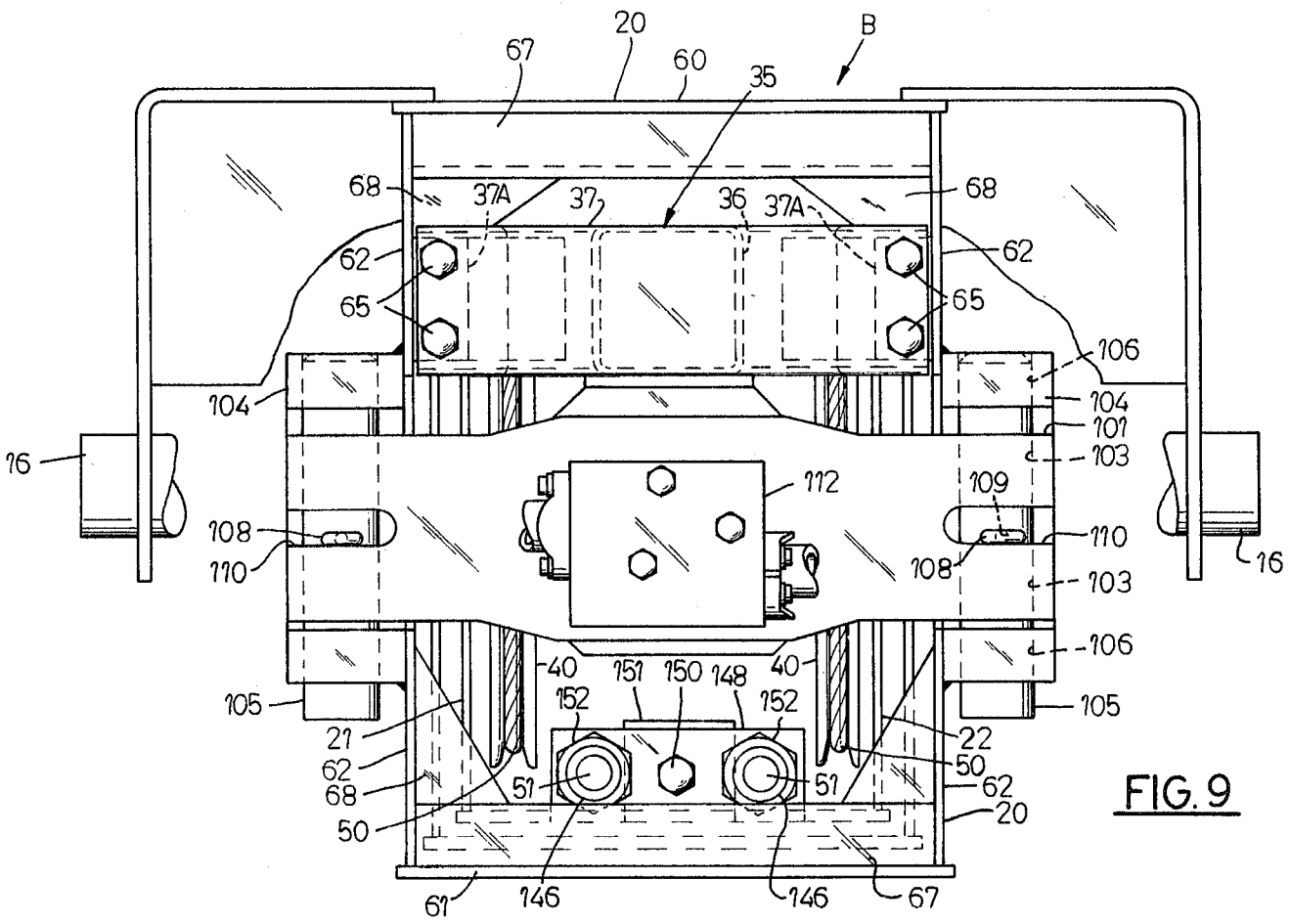
FIG. 9 is an enlarged end elevational view of the base end of the boom shown in FIG. 3.
Figure 10:
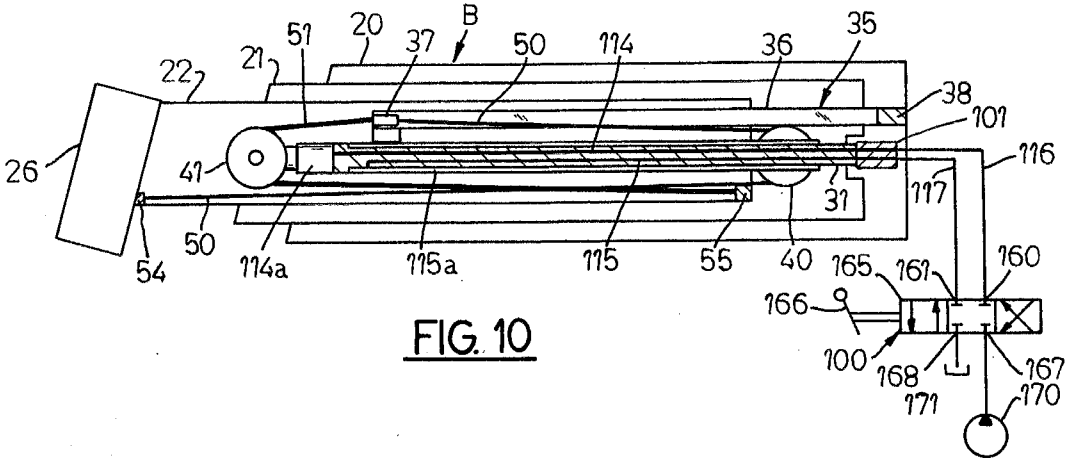
FIG. 10 is a schematic diagram of the crane boom showing it fully retracted.

As FIGS. 2, 3, and 9 best show, cable support means 35 includes an elongated hollow box beam 36 which extends into outer section 22 and has its rear end rigidly connected to the rear end of base section 20. Box beam 36 has a cable attachment assembly 37 connected to its forward end. More specifically, the rear end of box beam or member 36 is welded to a hollow box beam brace 38 which is transversely disposed thereto and rigidly supported within the rear end of boom base section 20. The ends of brace 38 receive and are supported by a pair of metal blocks 37A which are welded to the inner surfaces of the side walls 62 of base section 20. Each block 37A is provided with a pair of vertically spaced apart threaded bolt holes 39 for receiving mounting bolts 65 which extend through bolt holes 66 in the rear wall of brace 37. The rear end of base section 20 of boom B is strengthened and rigidified by upper and lower channel irons 67 which are welded therewithin to the inside surfaces of the top wall 60, the bottom wall 61 and the side walls 62. Suitable strengthening gussets 68 are also welded between the channel irons 66 and the side walls 62.

Figures 6, 7, 8:
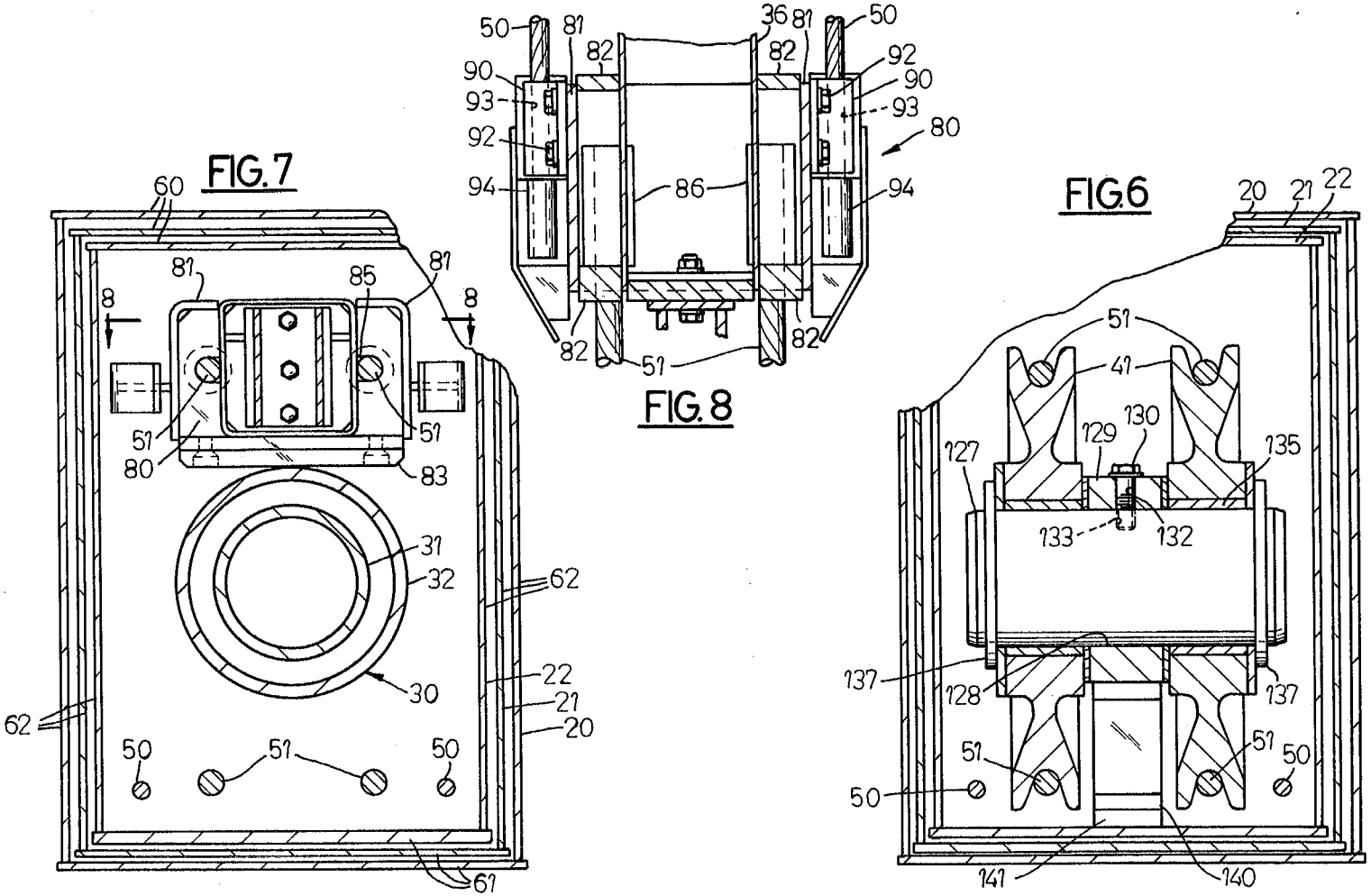
FIG. 6 is an enlarged cross-sectional view taken on line 6—6 of FIG. 3 and showing the pair of forward pulleys of the actuator mechanism.
FIG. 7 is an enlarged cross-sectional view taken on line 7—7 of FIG. 3 and showing a cable attachment assembly.
FIG. 8 is a top plan view of the cable attachment assembly taken on line 8—8 of FIG. 7.

As FIGS. 3, 7, and 8 best show, the cable attachment assembly 37 at the forward end of box beam 36 provides a fixed point (fixed relative to base section 20) for attachment of one end of each of the two retract cables 50 and the two extend cables 51. Assembly 37 comprises a base plate 80 which is welded to the front end of member 36, a pair of side plates 81 of L-shaped cross section which are welded to the edges of base plate 80 and end plates 82 at the ends of the side plates 81. Each end plate 82 is welded to an associated side of member 36, to the base plate 80 and to an associated side plate 81. Each of the forward end plates 82 is provided with a hole 85 for accommodating a cable 51 which extends therethrough. One end of each cable 51 is provided with a sleeve 86 which is press-fitted or swaged thereon and engages a plate 82, thereby serving as a means whereby cable 51 is connected to the end of cable support member 35.

A slide pad 82 is fastened to the bottom of block 80 which enables cylinder 32 of ram 30 to move relative to assembly 37 and to also avoid downward deflection of cable support member 36.

Assembly 37 further comprises a pair of cable support brackets 90 which are connected to the exterior of the side plates 81 by bolts 92. Each support bracket 90 comprises a passage 93 for accommodating a cable 50 which extends therethrough. One end of each cable 50 is provided with a sleeve 94 which is press-fitted or swaged thereon and engages an end of an associated bracket 90, thereby serving as a means whereby a cable 50 is connected to the end of cable support member 35.

As FIGS. 2, 3, 5, 6, 9, 10, and 11 show, the telescopic hydraulic ram 30 of the actuator mechanism comprises two relatively movable ram components, such as a hollow cylinder 32 and a hollow piston rod 31 slideably movable therewithin. The rear end of piston rod 31 is rigidly connected to the rear end of boom base section 20 by means of a rigid support bracket 101. Support bracket 101 is welded to piston rod 31 and is an integral part of the hydraulic arm 30. Support bracket 101 also includes a pair of vertically disposed laterally spaced apart pin-receiving holes 103 therethrough for receiving a pair of mounting pins 105 which attach the bracket 101 to the flange members 104 welded on the exterior of the side walls 62 of base section 20. More specifically, each side wall 62 supports a pair of vertically spaced apart flange members 104 between which one end of the bracket 101 is disposed. Each flange member 104 includes a pin-receiving hole 106 which is aligned with the associated pin-receiving hole 103 in bracket 101 and is adapted to receive a mounting pin 105. Each pin 105 is retained in position by means of a cotter pin 108 which extends through a transverse hole 109 in the pin 105 and each end of the bracket 101 is provided with a slot 110 which affords access for the cotter pin.

A hose fitting block or manifold 112 is rigidly mounted on bracket 101 and serves as a means by which hydraulic fluid is supplied to or removed from the fluid passages 114 and 115 in the piston rod 31 and the chambers 114a and 115a, respectively, in cylinder 32. As FIG. 10 shows, lines 116 and 117, which communicate with the passages 114 and 115 in piston rod 31, are connected to the ports 160 and 161, respectively, of a manually operable threeposition four-way valve 165. Valve 165, which includes an operating lever 166, has a fluid supply port 167 and a fluid exhaust port 168 which are connected to a pump 170 and to a reservoir 171, respectively.

As FIGS. 2, 3, 5, 6, 10, and 11 show, the rear end of cylinder 32 of hydraulic ram 30 is rigidly connected by means of a pair of pins 120 to inner section 21 of boom B near the rear end of the inner section. Each pin 120 is rigidly connected to one side of a pin support member 121 which is mounted on cylinder 32. Each pin 120 engages a pin attachment block 123 which is rigidly secured as by welding to the inner surface of a side wall 62 of the inner section 21 of boom B. Thus, extension and retraction of ram 30 effects corresponding movement of inner section 21 relative the base section 20.

The pair of rear pulleys 40 are rotatably mounted on ram cylinder 32 near the rear end thereof on the pair of pins 120. Each pulley 40, which includes an antifriction bearing 125 surrounding an associated pin 120, is disposed between pin support member 121 and pin attachment block 123.

As FIGS. 3 and 6 best show, the pair of forward pulleys 41 are rotatably mounted on ram cylinder 32 near the front end thereof by means of a large pin 127 which is secured in a hole 128 through a support bracket 129 which is rigidly attached to the forward end of cylinder 32 of ram 30. A bolt 130 extends through a bolt hole 132 in bracket 129 and screws into a threaded hole 133 in pin 127 to secure the pin 127 in place. Each pulley 41, which includes an antifriction bearing 135 surrounding the pin 127, is disposed between a side of bracket 129 and a snap ring 137 which engages a groove (not shown) in pin 127.

The forward end of ram 30 is supported against downward deflection by means of a support leg 140 which is rigidly secured to the underside of support bracket 129 and an antifriction slide pad 141 is provided at the lower end of support leg 140 and rests in sliding engagement on the inner surface of bottom wall 61 of outer boom section 22. This arrangement provides for proper support of the forward end of ram 30 while still enabling inner section 22 to be slideably moved relative to the ram.

Figure 5:
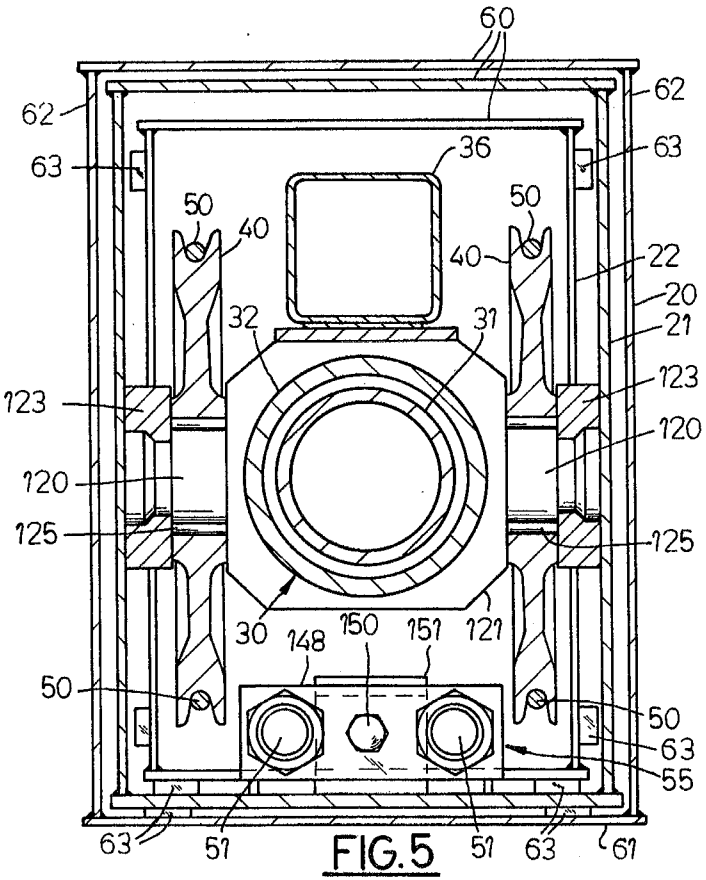
FIG. 5 is an enlarged cross-sectional view taken on line 5—5 of FIG. 3 showing the pair of rear pulleys of the actuator mechanism.
Figure 4:
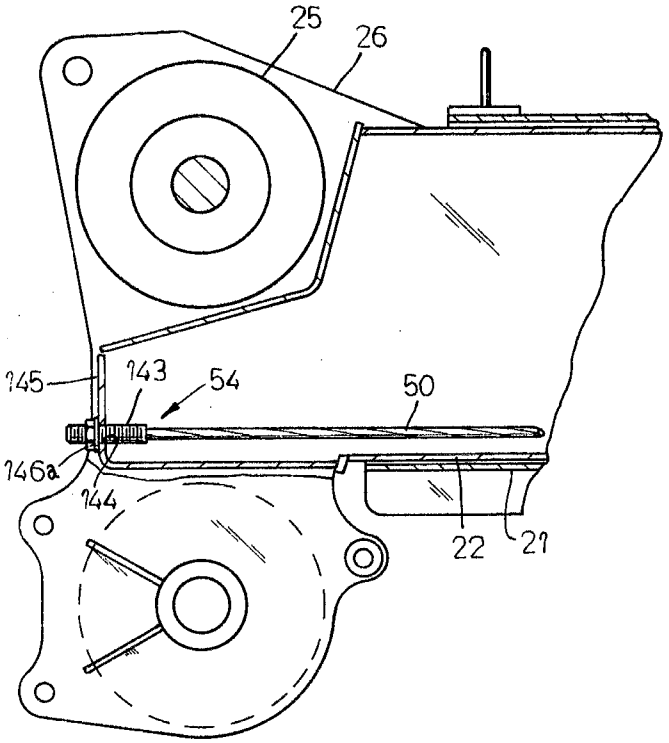
FIG. 4 is an enlarged cross-sectional view showing the front end portion of the crane boom shown in FIG. 3.

As FIG. 4 shows, cable anchor assemblies 54 are provided at the other end of each of the two cables 50 whereby a cable 50 is rigidly but adjustably secured to the forward end of outer boom section 22. Specifically, the other end of each cable 50 is press-fitted or swaged to an externally threaded sleeve 143 which extends through a hole 144 in an end plate 145 which is welded to boom point support 26 at the forward end of outer boom section 22. A nut 146a on the threaded portions of sleeve 143 maintains the associated cable 50 at the desired tension, depending on the extent to which the unit is tightened on the sleeve. As FIGS. 3, 5, and 9 show, cable anchor assemblies 55 are provided at the other end of each of the two cables 51 whereby a cable 51 is rigidly but adjustably secured to the rear end of outer boom section 22. Specifically, the other end of each cable 51 is press-fitted or swaged to an externally threaded sleeve 146 which extends through a hole 147 in an end plate 148 which is secured by a bolt 150 to a bracket 151 which is welded to the bottom wall 61 at the rear end of outer boom section 22. A nut 152 on the threaded portion of sleeve 146 maintains the associated cable 51 at the desired tension, depending on the extent to which the nut is tightened on the sleeve.

OPERATION

The boom B of crane 10 operates in the following manner. Assume that the boom B is initially in the condition shown in FIG. 10 with the boom sections 21 and 22 fully retracted relative to base section 20. Further assume that in the control means 100 shown in FIG. 10 the pump 170 is in operation but the valve 165 is in neutral position. To extend the boom B, the valve lever 166 is moved from neutral to extend position, fluid flows from the pump 170, through the valve 166, through line 116, and through fluid passage 114 in rod 31 to the chamber **114*a* within cylinder housing 32. As this occurs, cylinder housing 32 moves in a direction toward the front end of the boom B. Since cylinder housing 32 is connected to inner boom section 21, the latter also moves toward the front end of the boom with respect to the stationary base section 20. As cylinder housing 32 so moves, the forward extend pulleys 41 cooperate with their associated extend cables 51 so that the cables 51 pull, by means of their cable attachment assemblies 55, the outer section 22 in a direction toward the front of boom B. Axial movement of outer section 22 is not inhibited by the cables 50 because the pulleys 40 are mounted on and axially movable with cylinder 32** as the latter moves toward the front of the boom.

To retract the boom B, the valve lever 166 is moved from neutral to retract position, fluid flows from the pump 170, through the valve 166, through line 117 and through fluid passage 115 in rod 31 to the chamber 115a within cylinder housing 32. As this occurs, cylinder housing 32 moves in a direction toward the rear end of the boom B. Since cylinder housing 32 is connected to inner boom section 21, the latter also moves toward the rear end of the boom with respect to the stationary base section 20. As cylinder housing 32 so moves, the rear retract pulleys 40 cooperate with their associated retract cables 50 so that the cables 50 pull, by means of their attachment assemblies 54, the outer section 22 in a direction toward the rear of boom B. Axial movement of outer section 22 is not inhibited by the cables 51 because the pulleys 41 are mounted on and axially movable with cylinder 32 as the latter moves toward the rear of the boom.

It is to be understood that, during either extension or retraction, the rate of axial movement of outer section 22 with respect to inner section 21 is the same as the rate of axial movement of inner section 21 with respect to base section 20. However, outer section 22 moves with respect to base section 20 at a rate of speed which is twice that of the rate of speed of movement of inner section 21 with respect to base section 20.

Boom B can be partially or fully extended or retracted depending on when valve 165 is returned to neutral position.

Figure 11:
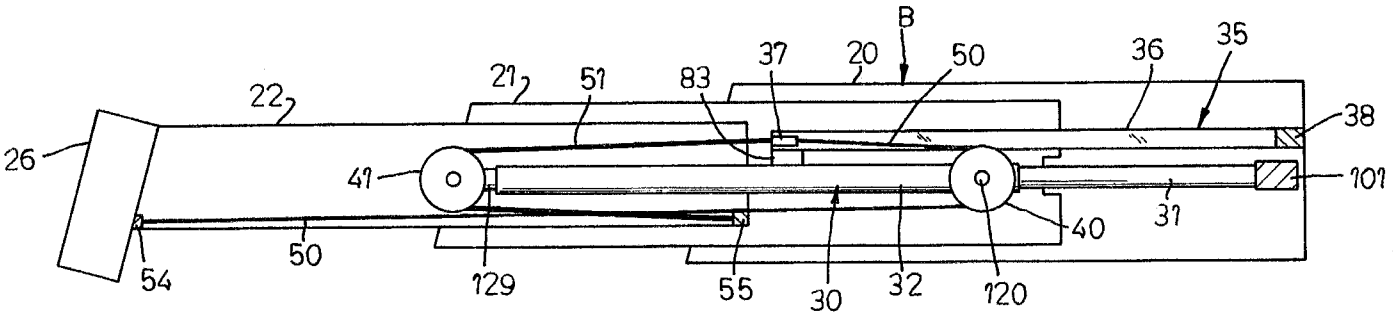
FIG. 11 is a view similar to FIG. 10 showing the crane boom partially extended.

Boom B is retracted from the position shown in FIG. 11 to the position shown in FIG. 10, for example, by moving the control lever 166 of the valve 165 from neutral to the retract position.

We claim:

1. In a telescopic boom:
a first section (20);
a second section (21) telescopable within said first section (20);
a third section (22) telescopable within said second section (21);
an extendable and retractable motor (30) comprising two relatively movable components (31, 32);
one (31) of said components being connected to said first section (20);
the other (32) of said components being connected to said second section (21);
first (40) and second (41) pulleys mounted for movement with said other component (32) and with said second section;
and first (50) and second (51) cables reeved around said first (40) and second (41) pulleys, respectively, and connected between said first section (20) and said third section (22), whereby operation of said motor (30) effects movement of said second section (21) relative to said first section (20) and movement of said third section (22) relative to said second section (21).

2. In a telescopic boom:
a first section (20);
a second section (21) telescopable within said first section (20);
a third section (22) telescopable within said second section (21);
an extendable and retractable motor (30) comprising two relatively movable components (31, 32);
one (31) of said components being connected to said first section (20);
the other (32) of said components being connected to said second section (21);
first (40) and second (41) pulleys mounted for movement with said other component (32) and with said second section;
and first (50) and second (51) cables reeved around said first (40) and second (41) pulleys, respectively, each cable (50, 51) having one end connected to said first section (20) and having another portion connected to said third section (22) whereby operation of said motor (30) effects movement of said second section (21) relative to said first section (20) and movement of said third section (22) relative to said second section (21).

3. In a telescopic boom:
a first section (20);
a second section (21) telescopable within said first section (20);
a third section (22) telescopable within said second section (21);
an extendable and retractable motor (30) comprising two relatively movable components (31, 32);
one (31) of said components being connected to said first section (20);
the other (32) of said components being connected to said second section (21);
first (40) and second (41) pulleys mounted on said other component (32);
cable support means (35) connected to said first section (20);
and first (50) and second (51) cables reeved around said first (40) and second (41) pulleys, respectively, each cable (50, 51) having one end anchored to said cable support means (35) and having the other end anchored to said third section (22) whereby operation of said motor (30) effects movement of said second section (21) relative to said first section (20) and movement of said third section (22) relative to said second section (21).

4. In a telescopic boom having front and rear ends;
a first section (20);
a second section (21) telescopable within said first section (20);
a third section (22) telescopable within said second section (21);
an extendable and retractable motor (30) comprising two relatively movable components (31, 32);
one (31) of said components having its rear end connected to said first section (20) near the rear end of the latter;
the other (32) of said components having its rear end connected to said second section (21) near the rear end of the latter;
first (40) and second (41) pulleys mounted in spaced apart relationship to each other on said other component (32);
cable support means (35) on said first section (20);
and first (50) and second (51) cables reeved around said first (40) and second (41) pulleys, respectively, each cable (50, 51) having one end anchored to said cable support means (35), said first cable (50) having its other end anchored to said third section (22) near the front end of the latter, said second cable (51) having its other end anchored to said third section (22) near the rear end thereof, whereby operation of said motor (30) effects movement of said second section (21) relative to said first section (20) and movement of said third section (22) relative to said second section (21).

5. A telescopic boom according to claim 4 wherein said motor is elongated and extends into said third section (22) and including means (141) for supporting the front end of said ram on said third section (22).

6. A telescopic boom according to claim 4 wherein said cable support means (35) conprises an elongated member (36) connected to said first section (20) near the rear end of the latter and extending into said third section (22).

7. A telescopic boom according to claim 6 including means (83) for supporting the front end of said elongated member (36) on said ram (30).

8. A telescopic boom according to claim 5 wherein said motor (30) is a hydraulic ram having a cylinder housing (32) and a piston rod (31).

9. A telescopic boom according to claim 8 including control means (100) for said hydraulic ram (30), said control means including a manifold (112) mounted on said hydraulic ram (30).

10. A telescopic boom according to claim 9 wherein said manifold 112 is mounted on said piston rod (31) of said hydraulic ram (30) and wherein said piston rod (31) includes fluid passages (114 and 115) communicating between said manifold (112) and fluid chambers (114a and 115a) in said cylinder housing (32).

11. A telescopic boom according to claim 6 wherein said first (20), second (21), and third (22) sections of said boom are base, inner, and outer sections, respectively, of said boom.

12. In a telescopic boom having front and rear ends:

a first section (20);

a second section (21) telescoped within said first section (20);

a third section (22) telescoped within said second section (21);

an extendable and retractable hydraulic ram (30) comprising first (31) and second (32) relatively movable elongated ram components;

said first ram component (31) having its rear end connected to said first section (20) near the rear end of the latter;

said second ram component (32) having its rear end connected to said second section (21) near the rear end of the latter;

cable support means (35) connected to said first section (20) and located within said boom;

a pair of first (40) and a pair of second (41) pulleys mounted near opposite ends of said second ram component (32);

a pair of first cables (50) reeved around said first pulleys (40) and having one end anchored to said cable support means and having its other end anchored to said third section (22) near the front end of the latter;

and a pair of second cables (51) reeved around said second pulleys (41) and having one end anchored to said cable support means and having their other ends anchored to said third section (22) near the rear end of the latter;

means for effecting movement of said ram (30) to thereby effect movement of said second section (21) relative to said first section (20), whereby movement of said second section (21) by said ram (30) effects movement of said third section (22) by said cables (50, 51) and said pulleys (40, 41).

13. A telescopic boom according to claim 12 wherein said cable support means (35) comprises an elongated member (36) connected to said first section (20) near the rear end of the latter and extending into said third section (22).

14. A telescopic boom according to claim 13 including means (83) for supporting the front end of said ram (30) relative to said third section (22) and means (141) for supporting the front end of said elongated member (36) relative to said ram (30).

15. A telescopic boom according to claim 14 wherein said motor (30) is a hydraulic ram having a cylinder housing (32) and a piston rod (31).

16. A telescopic boom according to claim 15 including control means (100) for said hydraulic ram, said control means including a control valve (165) and a manifold (112) mounted on said hydraulic ram (30).

17. A telescopic boom according to claim 16 wherein said manifold (112) is mounted on said piston rod (31) of said hydraulic ram (30) and wherein said piston rod (31) includes fluid passages (114 and 115) communicating between said control valve (165) and fluid chambers (114a and 115a) in said cylinder housing (32).

18. A telescopic boom according to claim 17 wherein said first (20), second (21), and third (22) sections of said boom are base, inner, and outer sections, respectively, of said boom.

* * * * *